US009237796B2

(12) United States Patent
Finch et al.

(10) Patent No.: US 9,237,796 B2
(45) Date of Patent: Jan. 19, 2016

(54) ASSISTIVE APPARATUS FOR HAND HELD VESSELS OR ITEMS

(71) Applicants: Theresa Rose Finch, Harrisville, RI (US); Peter Denis Finch, Harrisville, RI (US); Daniel Richard Cook, Worcester, MA (US)

(72) Inventors: Theresa Rose Finch, Harrisville, RI (US); Peter Denis Finch, Harrisville, RI (US); Daniel Richard Cook, Worcester, MA (US)

( * ) Notice: Subject to any disclaimer, the term of this patent is extended or adjusted under 35 U.S.C. 154(b) by 64 days.

(21) Appl. No.: 14/191,087

(22) Filed: Feb. 26, 2014

(65) Prior Publication Data

US 2015/0237995 A1 Aug. 27, 2015

(51) Int. Cl.
*B65G 7/12* (2006.01)
*A45F 5/00* (2006.01)

(52) U.S. Cl.
CPC ..... *A45F 5/00* (2013.01); *A45F 2005/006* (2013.01); *A45F 2200/0516* (2013.01); *A45F 2200/0583* (2013.01)

(58) Field of Classification Search
CPC ..... A45F 5/00; A45F 2005/006; A45F 2200/0516; A45F 2200/0583
USPC ..... 294/25, 149, 152, 157, 31.2
See application file for complete search history.

(56) References Cited

U.S. PATENT DOCUMENTS 263,726 A * 9/1882 Riley ..... B61G 7/02 294/18
1,596,076 A * 8/1926 Clancy ..... 294/31.2
1,943,567 A * 1/1934 Tweedie ..... 2/20
3,178,724 A * 4/1965 Perschke ..... 2/16
3,358,527 A * 12/1967 Lake ..... B60W 30/18 294/25
3,381,304 A * 5/1968 Coco ..... 2/20
3,398,951 A * 8/1968 Disko ..... 473/61
3,541,990 A * 11/1970 Du Mas ..... B63B 35/817 104/202
3,563,545 A * 2/1971 Rasche ..... 473/61
3,896,498 A * 7/1975 Pang ..... 2/20
4,435,008 A * 3/1984 Black ..... 294/25
4,684,559 A * 8/1987 Wasko ..... 428/100
4,809,974 A * 3/1989 Buhr ..... 482/139
5,147,079 A * 9/1992 Heather ..... 224/148.6
5,505,353 A * 4/1996 Marsh, Jr. ..... 224/148.6
5,622,346 A * 4/1997 Story, Jr. ..... 248/311.2
5,660,309 A * 8/1997 Belanger et al. ..... 224/250
5,722,575 A * 3/1998 Smith ..... 224/217
5,746,685 A * 5/1998 Glaser ..... 482/93
5,888,180 A * 3/1999 Dewberry ..... 482/139
6,003,918 A * 12/1999 Hulyk ..... 294/149
6,223,958 B1 * 5/2001 Kohn ..... A45C 1/04 224/219
6,244,639 B1 * 6/2001 Storck ..... 294/25
7,484,273 B1 * 2/2009 Dupree et al. ..... 24/3.13
7,896,414 B1 * 3/2011 Brigham ..... 294/26
8,061,750 B1 * 11/2011 Hamilton ..... 294/149
2002/0104202 A1 * 8/2002 Henry et al. ..... 24/306
2004/0004367 A1 * 1/2004 Main et al. ..... 294/150
2005/0274753 A1 * 12/2005 Swentor et al. ..... 224/148.6

(Continued)

*Primary Examiner* — Gabriela Puig

(57) ABSTRACT

The assistive apparatus for hand held vessels or items is a device worn on the hand to facilitate the holding of anything of weight and to reduce the need for gripping strength. The device is a length of flexible material with at least two loops; one at either end; such that the loops are worn over the thumb and the pinky or one or more other fingers. The flexible material hangs like a hammock and allows the weight of an object, such as a glass or tool, to rest on the skeletal structure of the hand rather than depending upon the mechanical gripping force exerted by fingers. The device has application to help individuals suffering from a weakened grip from an ailment, such as arthritis, or that are in professions that require holding heavy objects for extend periods of time.

2 Claims, 7 Drawing Sheets

(56) References Cited

U.S. PATENT DOCUMENTS

| | | | | |
|---|---|---|---|---|
| 2006/0055191 | A1* | 3/2006 | Isaacson | 294/152 |
| 2008/0303300 | A1* | 12/2008 | Hill et al. | 294/152 |
| 2009/0277935 | A1* | 11/2009 | Hanson | 224/148.4 |
| 2010/0181793 | A1* | 7/2010 | Lopreiato | 294/152 |
| 2011/0290835 | A1* | 12/2011 | Bartet | 224/267 |
| 2013/0240579 | A1* | 9/2013 | Yu | 224/217 |
| 2013/0240580 | A1* | 9/2013 | Yu | 224/217 |
| 2013/0270851 | A1* | 10/2013 | Konyha | 294/142 |
| 2013/0300141 | A1* | 11/2013 | Byrne | 294/25 |
| 2014/0132017 | A1* | 5/2014 | Hayes | 294/149 |

* cited by examiner

ASSISTIVE APPARATUS FOR HAND HELD VESSELS OR ITEMS

This patent application claims the benefit of U.S. provisional patent application No. 61/771,003 filed on Feb. 28, 2013, which is hereby incorporated by reference.

FIELD

The invention in the disclosed embodiments relates, in general, to a device worn on the hand to facilitate the holding of anything of weight to reduce the need for gripping strength.

The invention relates for use in the medical field for supporting beverage-ware or any and all containers/receptacles to assist holding and drinking, where a medical condition reduces the normal gripping force of the hand or fingers.

Secondarily, the invention relates for a general use as a novelty item for supporting beverage-ware at parties or functions. In these settings, the invention can be accompanied by a logo, an advertising statement, as a novelty-item, or for a party keepsake.

Additionally, the invention relates for use in the industry field for use with industrial containers (e.g. a can of paint, jar of oil, tumbler, beaker, or other vessels) or devices used in servicing or manufacturing fields where a can, jar, tumbler, beaker, or other container/receptacle holding a spill-able substance (eg: paint, powder, grease, oil, chemicals, other industrial contents housed in a container) can be held securely. This would be particularly useful for workers in manufacturing or service industry that require holding something of weight for long periods of time. (e.g.: a painter doing trim work).

Also, the invention relates for use with personal hand held devices that must be held for a long time while engaged in recreational pursuits for example while: hunting, fishing, jogging (e.g. holding weights while running for physical conditioning), walking, reading books, reading or watching personal tablets (as in holding electronic devices such as an iPad, iPod, tablet, e-readers, or one of the many other personal devices which are held for long periods of time.))

Furthermore, the invention relates for use in the manufacturing field for use with mechanical or static devices that must be held for an extended period of time for the purpose of work or pleasure to assist the wearer in "holding on" to whatever device must be held; thus lessoning hand fatigue or strain (e.g. a mechanic or carpenter holding a drill for extended periods of time, beautician holding a hair dryer).

BACKGROUND

Various medical conditions, such as arthritis, neuropathy, multiple sclerosis, stroke, Parkinson's disease, or even missing digits, can result in a weakened grip. One impact of this condition is a lack of strength to hold objects. In many persons, the condition is advanced enough to make holding a glass, mug or bowl difficult, especially when filled with a beverage or food item. Consequently, the simple act of taking a drink or holding a bowl of pudding so that it may be consumed becomes difficult; resulting in unwanted spills and accidents. The assistive apparatus for hand held vessels (AAHHV) alleviates this problem keeping these vessels firmly placed in the hand with minimal need for gripping strength. Another benefit of the (AAHHV) is that it is simple to use, easy to put on and take off, and can be left on the hand after a vessel is removed and the hand still has almost all its previous functionality and mobility.

The purpose of the invention is to facilitate the holding of anything of weight and to reduce the need for gripping strength. It is a simple device that allows the weight of vessels or items to be held by the structure of the hand as supported by a "hammock" rather than depending upon the mechanical force exerted by the fingers. This is especially useful to people who have reduced grip strength for various medical reasons, or for people who must hold vessels or items for extended periods of time. The weight of the vessels or items is now distributed to the skeletal bones, and limited gripping force is needed to successfully hold the items.

Former approaches to assist persons who have difficulty holding cups, have supplied several solutions such as duel plastic handles with a ring in which a cup or glass is inserted, or whole specialized cups with increased handle circumference or rubberized handles. These specialized handles or holders are used in conjunction with a container or are themselves the container. These devices have several disadvantages. One is they only accommodate certain cups and, no stem wear, and no vessels with handles such as a mug. Secondly, they tend to be made of hard plastic, are bulky, are not easily transportable for seniors, and tend to be very obvious; drawing attention to the person with the disability and causing public embarrassment. The AAHHV, however, is light weight, compact, affordable, easily portable, discrete, and allows seniors or anyone with gripping problems confidence in holding.

BRIEF SUMMARY

The object of the invention is to provide an inexpensive, discreet apparatus to be worn on the hand that assists the wearer in the holding of a cup, container or other hand held item. In its simplest embodiment, the invention is a simple length of flexible material with loops at either end to fit over the thumb and one other finger of the hand. This then allows the weight of containers to be held by the skeletal structure of the hand rather than depending upon the mechanical gripping force exerted by the fingers.

The apparatus is a light weight, easily used, versatile holder for various vessels and items. Its purpose is twofold: to assist those who due to physical ailments have reduced finger strength and thus aid them in holding a cup to drink from or small bowl from which to eat; and secondly, to reduce hand fatigue and strain, especially to the distal joints, for those who hold objects for extended periods of time. The apparatus changes the leverage of the device from stress on the distal joints to the proximal joints, enabling the skeletal structure of the hand to support weight of a hand held object, as opposed to depending on the gripping strength of the fingers and hand.

Former approaches present specialized handles or holders which are used in conjunction with a specific type of built in container. These have the disadvantage of adding bulk and weight. The "sippy cup" styles or double handled styles bring attention to the infirmity of the user and may cause embarrassment. Such items have limited portability. Additionally, the cups they use are specific to the holder being used and are not universal in their use.

The novel features of this invention are: (1) the use of a simple length of flexible material with two loops to form a holder in the hand to aid in the holding of heavy objects. (2) The simple design means it is inexpensive to manufacture, (3) the invention stacks easily, is portable, and versatile; and (4) can hold multiple cup sizes and shapes instead of limited to one type of cup.

DETAILED DESCRIPTION

The disclosed embodiments of the invention are to provide an inexpensive, discreet apparatus to be worn on the hand that assists the wearer in the holding of a cup, container or other hand held object. In its simplest embodiment the invention is a simple length of flexible material with loops at either end to fit over the thumb and one other finger of the hand. This then allows the weight of containers to be held by the skeletal structure of the hand rather than depending upon the mechanical gripping force exerted by the fingers.

Figure 1A:
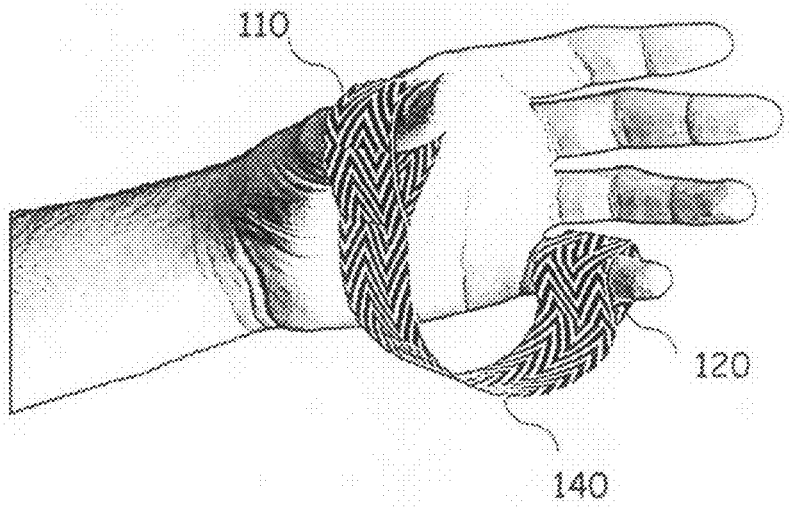
FIG. 1A is an illustration showing how an embodiment is worn on the thumb and pinky finger.

FIG. 1A shows an illustration of the invention, which at its simplest, is a strip of flexible material with two loops at either end. The thumb-loop 110 is worn over the thumb and the finger-loop 120 is worn over the pinky finger. A container or glass in now placed on the non-liner strip of flexible material at 140. The weight of a container, glass or object is now distributed to the skeletal bones, and limited gripping force is needed to successfully hold these items. Additionally, the weight of the vessels or items is closer to the whole hand, as opposed to the ends of the fingers or distal joints. This moves the center of gravity inward towards the larger muscles of the hand (as opposed to the fingers) thus reducing stress and fatigue on the fingers. The overall result is a more secure "grip".

Figure 1B:
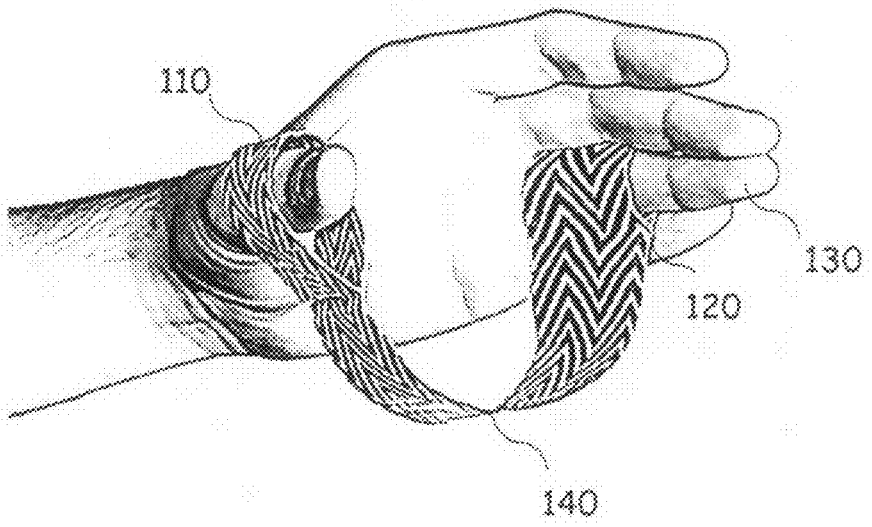
FIG. 1B is an illustration showing how an embodiment is worn on the thumb and ring finger.

FIG. 1B shows an illustration of the invention where the thumb-loop 110 is worn over the thumb and the finger-loop 120 is worn over the ring finger 130. This embodiment might be made due to extensive arthritis in the pinky thus perhaps resulting in pain, a weak or bent pinky, a missing pinky. Wearing the embodiment in this way causes the device to sit higher in the hand, for additional strength and comfort, or simply preference of the wearer.

The non-liner strip of flexible material 200 used to construct the invention can be, but is not limited to, a flexible fabric made from leather, suede, neoprene, nylon or cotton webbing, boiled wool, duct tape, washable fabric, synthetic rubber, scotch guarded fabric, elastic, or any other flexible thin material that will support a vessel to be comfortably held in the hand; or any combination of fabrics: The length and width of the fabric are variable and are not limited, but are sized such that they are worn over the thumb and "pinky" or "ring finger" to form a platform 140. Typically, the length and width of the material varies from person to person and depends on the size of the hand, the size (length and breadth) of the fingers, and the size of the article to be held. For example, an embodiment for holding a large water bottle will vary from that of holding a small juice glass which ,would vary still from that of holding a power drill tool.

Figure 2A:
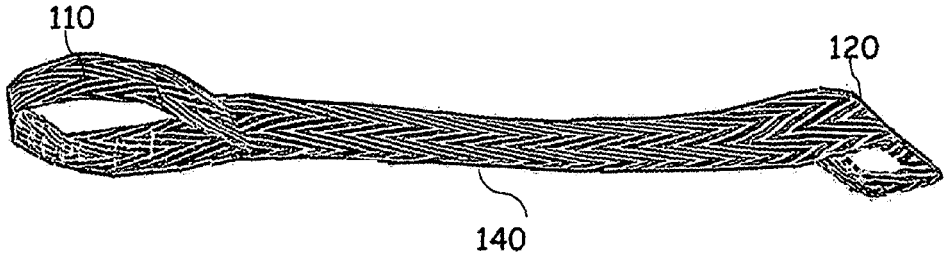
FIG. 2A is a non-limiting illustration according to the embodiments showing relative dimensions, thumb-loop and finger-loop.
Figure 2B:
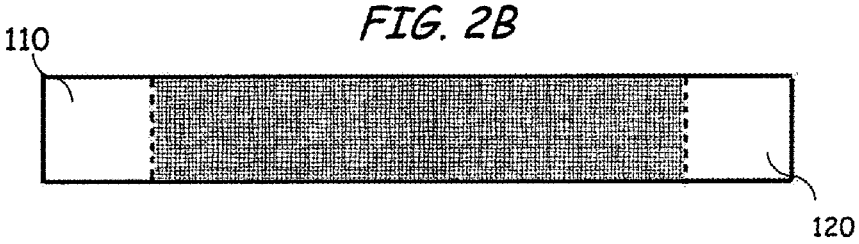
FIG. 2B is a bottom view of an example embodiment showing the flexible material with stitched thumb-loop and finger-loop.

FIG. 2A shows a non-limiting example embodiment. To manufacture the invention to hold a drinking tumbler for an average person, the apparatus is constructed in the following way: a length of flexible material, such as suede leather, is cut to a length of 32 cm and width of 4.5 cm. A finger-loop 120 for the pinky finger of diameter 2.25 cm, is constructed by folding over (wrong sides together) at the folding point 3.5 cm of one end of the length of material (e.g. FIG. 2D, 220) and attached with stitching 240, glue or other means of fastening. Similarly, a thumb-loop 110 for the thumb of diameter 3.5 cm is constructed by folding 5 cm of the other end of the flexible material (e.g. FIG. 2D, 210) on itself (wrong sides together) and is also attached with stitching 230, glue or other means of fastening. FIG. 2B shows a bottom view of the example embodiment where the flexible material has been folded over and attached to form a thumb-loop 110 and a finger-loop 120 , where the crosshatched area indicates the wrong side of the material and the clear the right side of the material.

Figure 2C:
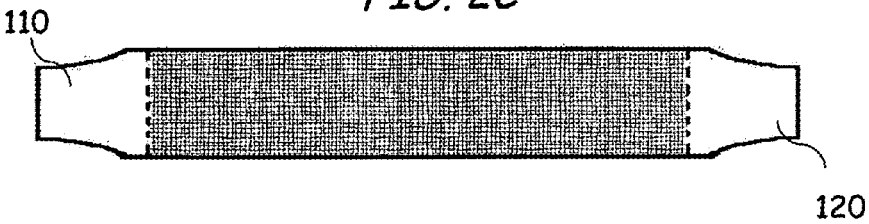
FIG. 2C is a bottom view of an example embodiment showing the flexible material with tapered or shaped thumb-loop and finger-loop.
Figure 2D:
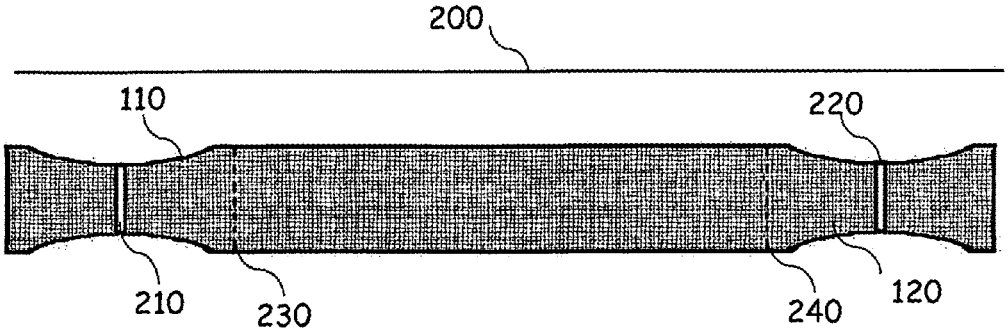
FIG. 2D is a bottom view of an example embodiment showing the flexible fabric with tapered or shaped thumb-loop and finger-loop prior to folding.

FIG. 2C illustrates one embodiment of the invention where the ends of the length of material for the thumb-loop 110 and finger loop 120 taper down for finger comfort. FIG. 2D shows a bottom view of this same embodiment before the flexible material has been folded to create the loops. The thumb-loop 110 is created by folding at 210 and affixing the material at 230. The finger-loop 220 is created by folding at 220 and affixing the material at 240. This design (FIG. 2C and FIG. 2D) helps accommodate those who may have shorter fingers or desire flexibility of the end one-third joint of the finger.

In addition to sewing to construct the loops, various embodiments can create the loops from a length of material where the ends are folded over and fastened with stitching, glue, adhesive, hook and loop, "snaps", or whatever material best suits the attachment to make a thumb-loop or finger loop.

In another embodiment, adjustable fasteners can be used with the thumb and finger loops to allow size adjustment. These attaching systems could be but not limited to: hook and loop; hook and eye; "snaps"; or some other fastening mechanism to allow for adjustability. Adjustability installed around the affixing points (FIG. 2D 230 and 240) allows for thumb-loop 110 and finger-loop120 to become adjustable in size or the entire length of the device to become longer or shorter depending on hand size, glass size, tool size, or need.

Figure 2E:
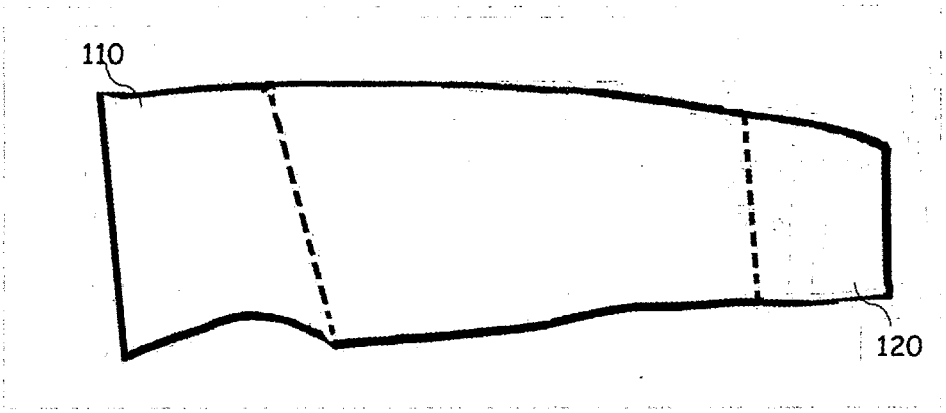
FIG. 2E is a top view of an example embodiment showing shaped flexible fabric with shaped thumb-loop and finger-loop after affixing.
Figure 2F:
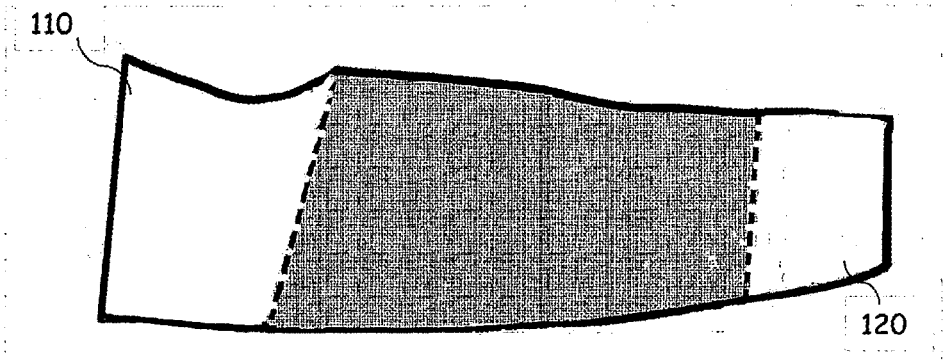
FIG. 2F is a bottom view of an example embodiment showing shaped flexible fabric with shaped thumb-loop and finger-loop after affixing.
Figure 3A:
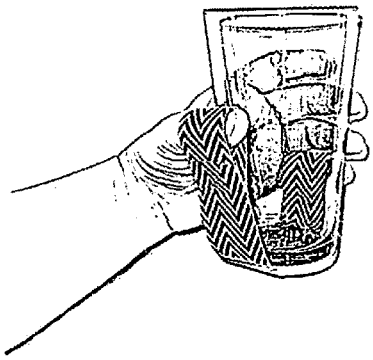
FIG. 3A is a side view showing the invention on the hand as used with a glass.
Figure 3B:
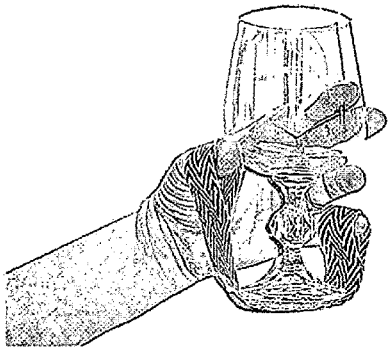
FIG. 3B is an example of the invention holding stem-ware.
Figure 3C:
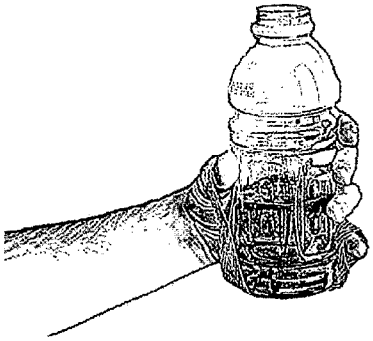
FIG. 3C is an illustration showing an embodiment of the invention holding a bottle.
Figure 3D:
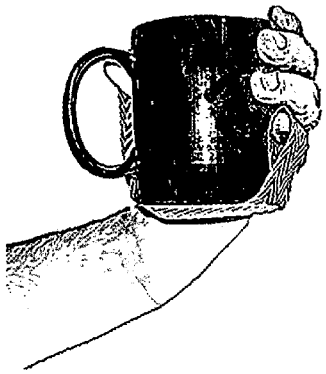
FIG. 3D is an example of the invention holding a handled vessel.

In another embodiment, the length of material 200 (FIG. 2D) will be cut with curves (FIG. 2E and FIG. 2F) rather than a rectangle. FIG. 2E shows a top view with the thumb-loop 110 curved for a right handed user. Note the narrower finger-loop 120 for the pinky finger. FIG. 2F shows a bottom view of the same embodiment, where the crosshatching indicates the wrong side of the material and the clear the right side. This embodiment can create a more secure, better controlled fit to the hand with additional support to force the vessel back into the crook of the hand and alleviate the possibility of the vessel toppling out of the opening of the hand.

Other embodiments can be envisioned where the length of material can take regular or irregular shaped sides.

FIGS. 3A, 3B, 3C, and 3D illustrate exemplary uses showing that the embodiments can accommodate any type of handled or non-handled vessel. Prior solutions do not have this ability. The figures illustrate that the weight of the vessels and their contents form a tight fit due to gravity.

Figure 4A:
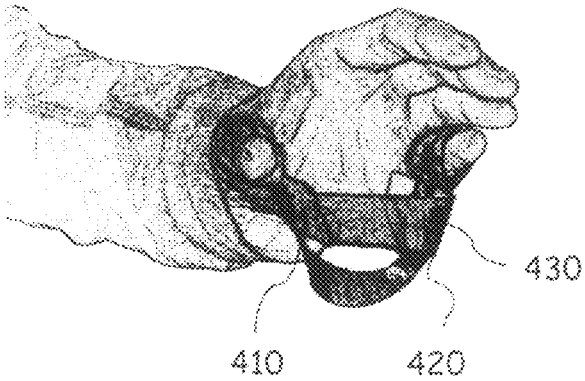
FIG. 4A is an example of the invention, front view, with a support strap attachment to help support said vessels from tipping out of the Hand Hammock.
Figure 4B:
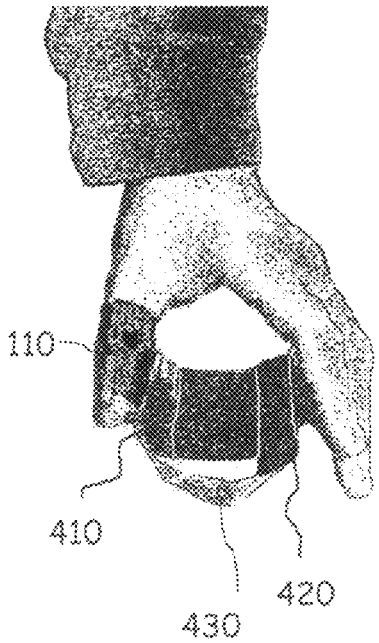
FIG. 4B is a top view of the invention with a support strap as described in FIG. 16.

FIGS. 4A and 4B illustrate an embodiment of the invention that includes a support strap 430. The support strap embodiment may be permanently affixed or affixed as an attachment to the apparatus. The strap 430 is affixed at 410 and to ensure that vessels or items do not tip or fall out of the hand. It would be used for a person with little or no finger grip strength, but with adequate arm and shoulder functionality. The strap helps hold the vessel in the hand and pushes the vessel or item closer toward the palm of the hand. This shifts the center of gravity closer to the palm of the hand further reducing stress on the distal joints and ensuring a secure grip. The "support strap" attachment 430 could go as high as the thumb-loop 110 and finger-loop 120. One embodiment of the support strap attachment 430 may be with fasteners. Another embodiment would use an accessory loop that threads through the thumb-loop and finger-loop.

FIG. 4B illustrates the top view of the embodiment from FIG. 4A, to highlight the curve of the support strap. 410 and 420 indicate the points where the support strap attaches to the flexible material that forms the hammock. The thumb-loop 110 is shown in FIG. 4B for orientation purposes.

Figure 5:
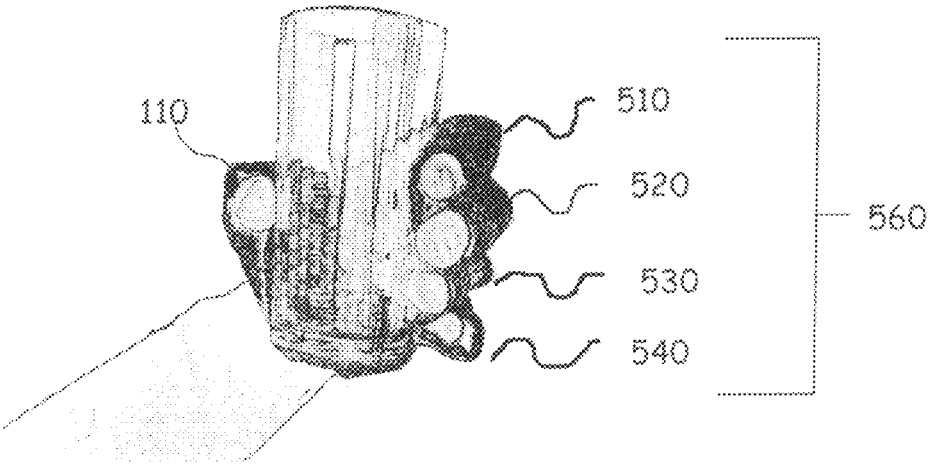
FIG. 5 is an example of the invention with material such as elastic fastened to the "hammock" portion of the invention in loops to fit multiple fingers.

FIG. 5 illustrates an embodiment of the invention in which each finger is supported by elastic, fabric or other material attached to the flexible material with loops for individual fingers 510, 520, 530, 540 to gain additional support. This embodiment would be used for someone who perhaps needed the additional support of all fingers, (due to severe arthritis or lack of finger strength) whose fingers were extensively bent, or who required said device be more firmly fastened to each finger to prevent slippage. An additional embodiment would be to make one large loop that could fit over all the fingers 560. Additional embodiments could include various combinations of loops to accommodate various finger combinations. The thumb-loop 110 is shown in FIG. 5 for orientation purposes.

Figure 6:
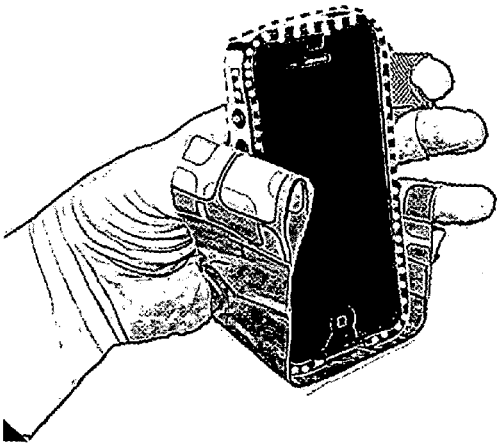
FIG. 6 is view of the invention used to hold a smart phone.

FIG. 6 shows an exemplary use of the invention with a smart phone. This design would work for other small personal electronic devices and tablets as well. An additional embodiment would provide slits in the main material such that the corner of each device would be held in to prevent slippage.

Figure 7:
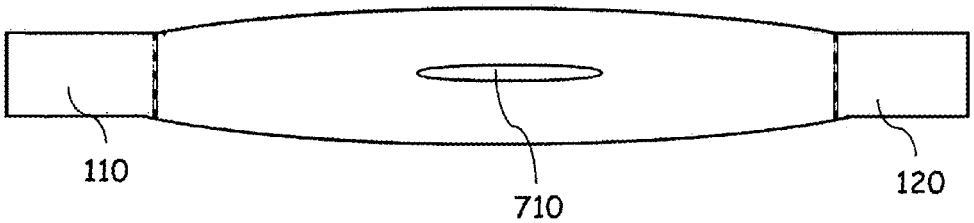
FIG. 7 shows another top view of the invention where a hole has been cut in the center strip to allow the passage of hoses or cables or other protuberances.

FIG. 7 shows a top view of an embodiment with a hole in the center 710 to accommodate a hose, handle or other protuberance to be allowed through the center of the invention for items such as a drill cord, hair dryer handle or electrical cord/air hose. The thumb-loop 110 and finger-loop 120 would still be used.

Figure 8:
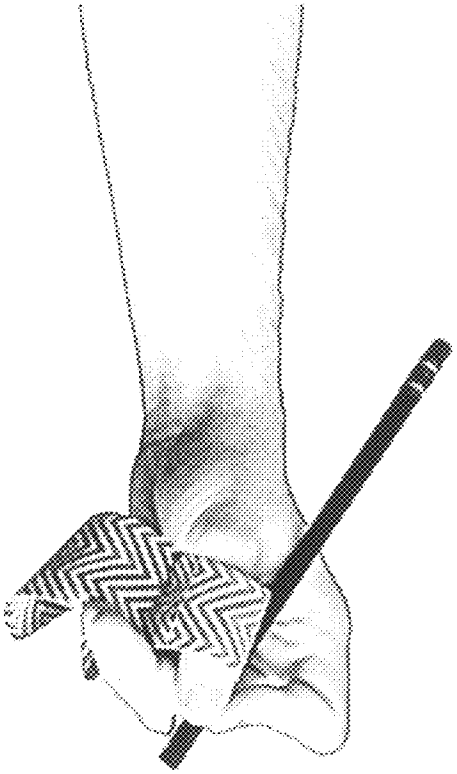
FIG. 8 is an illustration of an example use showing that hand flexibility and dexterity remains possible while wearing the invention.

FIG. 8 illustrates how embodiments of the invention can remain on the hand and the hand can still function. In this figure, the apparatus remains on the hand while using a pencil. This may be important in cases of frequent changing of items in the hand or simply for comfort of those who, due to mental or physical restrictions, are not able to remove the device themselves.

Those skilled in the art will appreciate that various adaptations and modifications of the exemplary and alternative embodiments described above can be configured without departing from the scope and spirit of the invention. Therefore, it is to be understood that, within the scope of the appended claims, the invention may be practiced other than as specifically described herein.

What we claim is:

1. An assistive device worn on a thumb of a user's hand and one other finger of the user's hand that aids in gripping and supporting a hand-held object where said assistive device is comprised of a strip of flexible material with two ends, a thumb-end and a finger end; and said strip having two edges, an inner-edge and an outer-edge; such that when the device is worn on the user's thumb and the user's finger, the inner-edge is closest to the user's palm and the outer-edge is opposite the inner-edge; where the strip has a thumb-loop formed by folding the thumb-end over itself and having the thumb-end thereof secured to an intermediate portion of said strip where the thumb-loop is sized to fit the user's thumb such that said user's thumb can be inserted into the thumb-loop, where a width of said strip on the thumb-end is long enough to form the thumb-loop that extends beyond the user's interphalangeal thumb joint when the user's thumb is inserted into said thumb-loop; where the strip has a finger-loop formed by folding the finger end over itself and having the finger end thereof secured to an intermediate portion of said strip where the finger-loop is sized to fit one other finger of the user such that said user's one other finger can be inserted into said finger-loop; where, when the device is worn by inserting the thumb in the thumb-loop and one other finger in the finger-loop, said strip, between the thumb-loop and the finger-loop, supports said hand-held object at its base and wherein a weight of the hand-held object pulls said thumb-end, which is encapsulated by said thumb-loop, and said finger, which is encapsulated by said finger-loop, together to aid in gripping and supporting the hand-held object; where said strip has a greater width at the thumb-end compared to a lesser width at the finger end; where the greater width of said strip at the thumb-end tapers from the thumb-end to the lesser width at the finger end in a non-linear way; and where said outer-edge between the thumb-loop and finger-loop has a greater linear length than the said inner-edge between the thumb-loop and the finger-loop.

2. The device according to claim 1: where on the inner-edge, used to make the thumb-loop, an indentation is sculpted out of said strip near said thumb-end such that when the thumb-loop is made, the indentation cut-out enables said device, on the thumb-end, to fit comfortably around the user's hand's webbed skin between the user's thumb and the user's index finger.

* * * * *